US006064158A

United States Patent [19]

Kishita et al.

[11] Patent Number: 6,064,158

[45] Date of Patent: May 16, 2000

[54] ELECTROLUMINESCENT DISPLAY DEVICE

[75] Inventors: Hiroyuki Kishita, Kariya; Masahiko Osada, Hekinan; Hiroaki Himi, Nagoya, all of Japan

[73] Assignee: Denso Corporation, Kariya, Japan

[21] Appl. No.: 09/204,169

[22] Filed: Dec. 3, 1998

Related U.S. Application Data

[62] Division of application No. 08/675,672, Jul. 3, 1996, Pat. No. 5,847,516.

[30] Foreign Application Priority Data

| | | | |
|---|---|---|---|
| Jul. 4, 1995 | [JP] | Japan | 7-168822 |
| Aug. 11, 1995 | [JP] | Japan | 7-206344 |
| Aug. 11, 1995 | [JP] | Japan | 7-206345 |

[51] Int. Cl.[7] ..... G09G 3/10

[52] U.S. Cl. ..... 315/169.3; 315/169.1; 345/76; 345/77; 345/95; 345/211

[58] Field of Search ..... 315/169.3, 169.1, 315/169.2, 241 R; 345/76, 79, 95, 204, 211, 209, 55, 77, 96, 103

[56] References Cited

U.S. PATENT DOCUMENTS

| | | | |
|---|---|---|---|
| 4,864,182 | 9/1989 | Fujioka et al. | 315/169.3 |
| 4,999,618 | 3/1991 | Inada et al. | 340/781 |
| 5,235,253 | 8/1993 | Sato | 315/169.3 |
| 5,973,456 | 10/1999 | Osada et al. | 315/169.1 |

FOREIGN PATENT DOCUMENTS

| | | |
|---|---|---|
| 60-147790 | 8/1985 | Japan . |
| 62-57293 | 4/1987 | Japan . |
| 63-199396 | 8/1988 | Japan . |
| 63-235991 | 9/1988 | Japan . |
| 1-121897 | 5/1989 | Japan . |
| 3-129698 | 6/1991 | Japan . |
| 3-181987 | 8/1991 | Japan . |
| 5-333815 | 12/1993 | Japan . |
| 7-31483 | 4/1995 | Japan . |

*Primary Examiner*—Haissa Philogene
*Attorney, Agent, or Firm*—Pillsbury Madison & Sutro LLP

[57] ABSTRACT

A scan driver IC for an EL element in an EL display device supplies, in a positive field, a positive polarity scan voltage and an offset voltage which is higher than ground to scan side driver ICs from voltage supply circuits, and the scan side driver ICs set voltage of scan electrodes to be the offset voltage in the positive field, together with outputting the positive polarity scan voltage to the scan electrodes during electroluminescence timing. Consequently, a voltage of Vr−Vm is applied to the scan side driver ICs, and so the breakdown voltage can be lowered by an amount corresponding to the offset voltage Vm. Circuits for providing such voltages, for providing alternating current drive voltages, and for reducing power consumption of the drive circuits are also disclosed.

8 Claims, 11 Drawing Sheets

POS. FIELD
NEG. FIELD
FIG.3A 51,62
FIG.3B 52,61

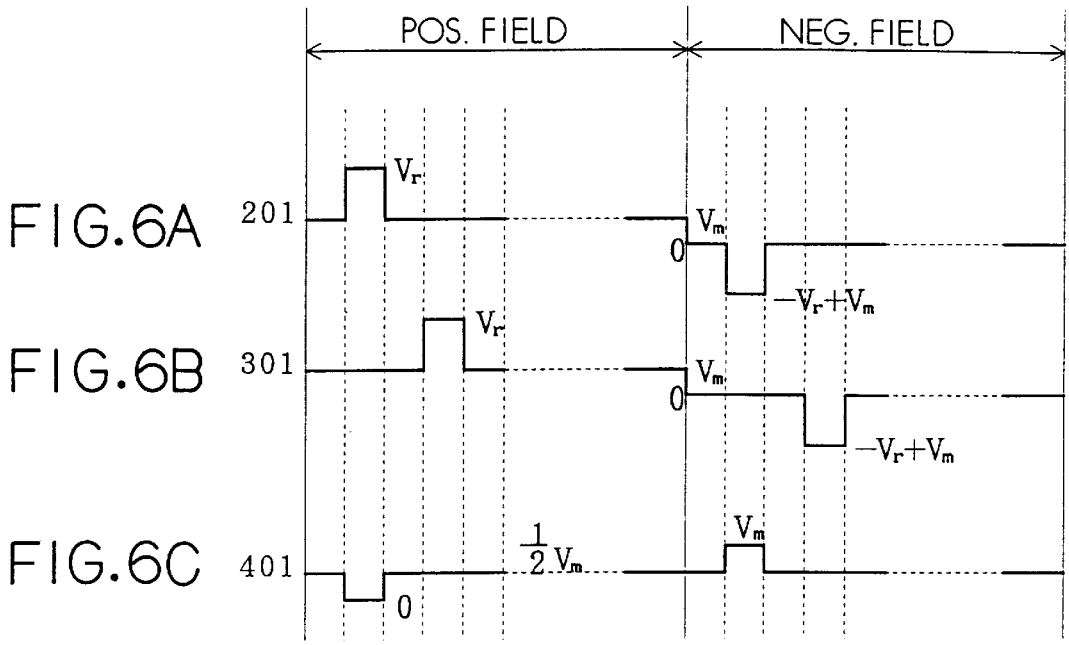
FIG. 7
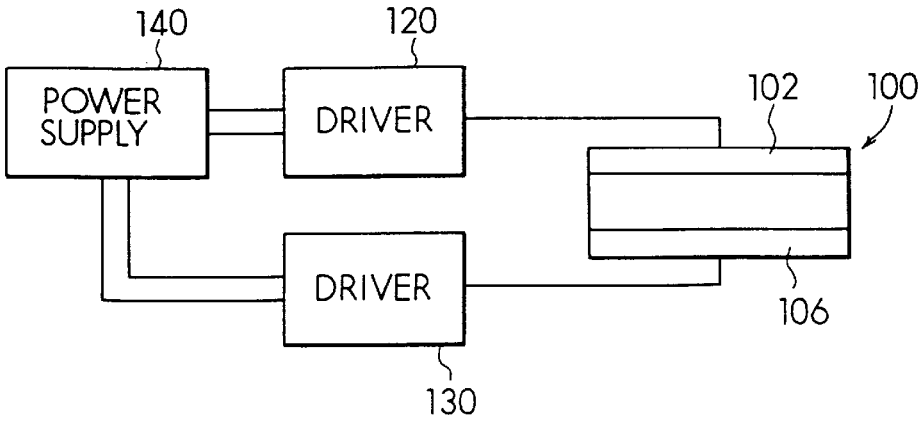

FIG.10
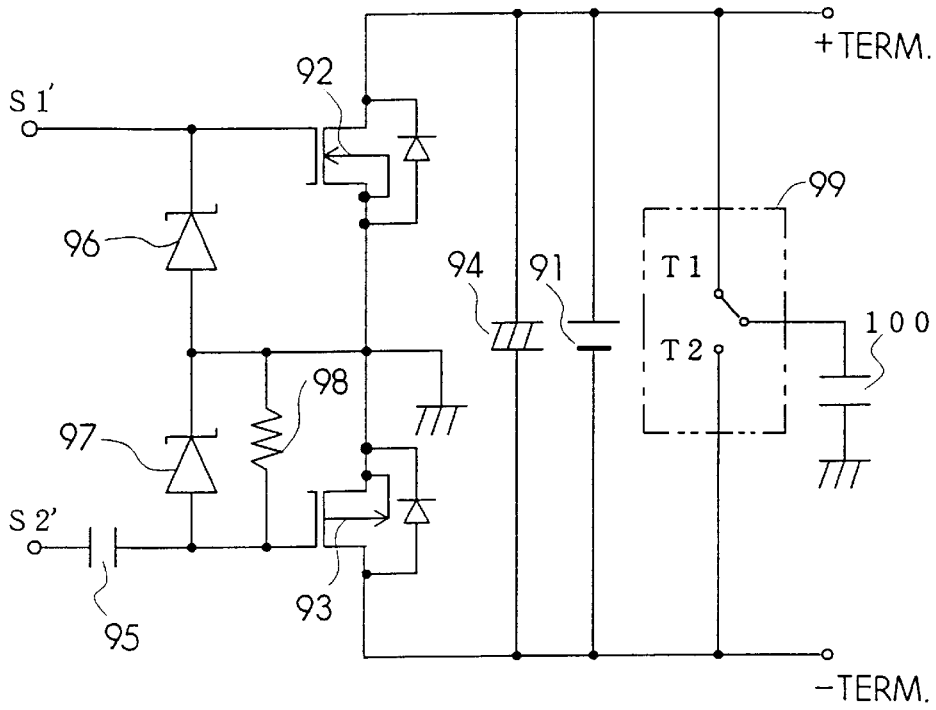
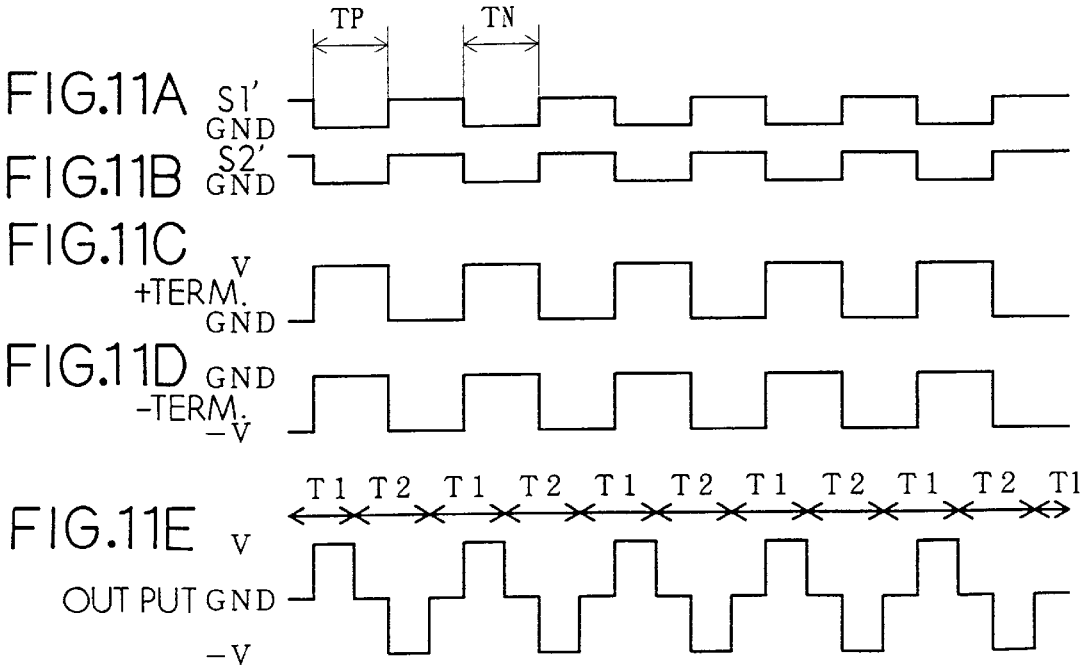

FIRST FIELD
SECOND FIELD
FIG.14A 51, 62
FIG.14B 52, 61

Vr
Vm
0
−Vr+Vm
½Vm
−½Vm
−Vr
Vr−Vm
−Vm

SECOND FIELD

702

703

704

P-CH.
FET

N-CH.
FET
$V_m$
$\frac{1}{2}V_m$

EL
ELEM.
0

ELECTROLUMINESCENT DISPLAY DEVICE

This is a division of Application Ser. No. 08/675,672 filed Jul. 3, 1996 now U.S. Pat. No. 5,847,516.

CROSS-REFERENCE TO RELATED APPLICATION

The present application is related to and claims priority from Japanese Patent Application Nos. Hei. 7-168822, 7-206344 and 7-206345, incorporated herein by reference.

BACKGROUND OF THE INVENTION

1. Field of the Invention

This invention relates to a circuit for driving an electroluminescent (EL) display device.

2. Description of Related Art

A device disclosed in Japanese Patent Application Laid-Open Publication No. Hei 5-333815 is known as a circuit for driving an EL display.

According to this device, EL elements in the display are arranged in a matrix and a scan side driver IC and data side driver IC are respectively provided on a scan side and data side of the display elements. Accordingly, drive voltage pulses having a differing polarity with each positive and negative field are applied to the EL elements by the respective driver ICs and the EL elements emit light.

That is to say, in the positive field, a ground voltage (0 V) is taken to be a reference voltage and a voltage Vr corresponding to an EL drive voltage is output to a scan electrode of the EL display from the scan side driver IC, and from the data side driver IC, the ground voltage is output to the EL element so that it emits light, a modulation voltage Vm is output to a data electrode of an EL element to put it in a non-electroluminescent state, voltage of the data electrode is grounded with respect to the scan electrode to which the voltage Vr has been output, the Vr voltage is applied to the EL element, and the EL element emits light.

Additionally, in the negative field, ground voltage (0 V) is taken to be a reference voltage and a voltage of −Vr+Vm is output to the scan electrode from the scan side driver IC, and from the data side driver IC, the modulation voltage Vm is output to the EL element so that it emits light, the ground voltage is output to a data electrode of an EL element to put it in a non-electroluminescent state, voltage of the data electrode is set at the modulation voltage Vm with respect to the scan electrode to which voltage of −Vr+Vm has been output, −Vr voltage is applied to the EL element, and the EL element emits light.

In a case wherein drive such as the foregoing is performed, the power source voltages of the scan side driver IC becomes Vr and ground voltage when driving in the positive field, and so the voltage Vr is applied to the scan side driver IC, and consequently the breakdown voltage thereof must be Vr or higher. Because the EL element is driven at a comparatively high voltage which becomes, for example, approximately 260 V, a device with high breakdown voltage as the scan side driver IC becomes necessary. Because a general purpose driver IC does not have such a high breakdown voltage, it is necessary to specially design a high breakdown voltage driver IC which has a high breakdown voltage to satisfy the above requirements, and this causes problems in terms of integration and cost. These considerations also apply to the data side driver side IC.

Further, when the rear electrode has been grounded and a positive and negative alternating current signal is applied to the transparent electrode, two types of positive and negative power sources normally become necessary, and power source circuitry becomes large.

Also, driving the above-described prior art device, electrical charging and discharging with respect to the EL display panel is performed at each scan line electroluminescence operation, and there exists a problem wherein drive power consumption per cycle becomes large.

The device disclosed in Japanese Patent Publication Laid-Open No. 63-168998 attempts to solve this problem. After an EL element has emitted light, accumulated charge is stored in a capacitor provided externally, and this accumulated charge is reused during subsequent electroluminescence, thereby reducing power consumption.

As shown in FIG. 15, this circuit includes a data voltage supply circuit 7 having a charge collection capacitor 701, switching elements 702 through 704, and diodes 705 and 706, and Vm/2 is utilized as the power source voltage. The size of the charge collection capacitor 701 is sufficiently large in comparison with the charge capacity of the entirety of the EL display panel, and a charge equivalent to Vm/2 is charged therein as an initial state.

Operation of this device will be described hereinafter with reference to the graphs shown in FIGS. 16A–16F.

In the second field, when performing drive for a predetermined scan line, firstly the switching element 704 is switched on as shown in FIG. 16C, a P-channel FET connected to a data electrode of an EL element to emit light is switched on and a corresponding N-channel FET is switched off as shown in FIGS. 16D and 16E, and voltage Vm/2 is applied to the data electrode as shown in FIG. 16F.

Next, the switching element 702 is switched on as shown in FIG. 16A, voltage Vm being power source voltage Vm/2 with Vm/2 corresponding to a capacitor charge added thereto is applied to the data electrode of the EL element to emit light, and the EL element emits light. Subsequent to this electroluminescence operation, the switching elements 702 and 704 are switched off, and approximately half of the charge output from the P-channel FET of the data side driver IC 4 is collected via the diode 705 in the charge collection capacitor 701.

The collected charge is consumed when switching on the switching element 704 in the subsequent scan line selection period. This operation is repeated until the final line.

However, structure and operation of the charge collection capacitor 701 of the above-described device are complex, and there are problems where applied voltage at the time of the next scan line selection is affected by an amount of accumulated capacitor charge and is unstable, and so on.

SUMMARY OF THE INVENTION

In light of the foregoing problems, it is an object of the present invention to provide a drive circuit that is able to drive an EL element, where the drive circuit for the EL element has a low breakdown voltage.

To attain the above-described object, an EL display device according to a first aspect of the present invention applies a scan voltage having a differing polarity with each positive and negative field to drive an EL display where the scan voltage includes, in a positive field, a positive polarity scan voltage and a first offset voltage which is higher than ground level to a scan electrode drive circuit from a voltage supply circuit, and the scan electrode drive circuit sets the voltage of a scan electrode to be the first offset voltage in the positive field, together with outputting the positive polarity scan voltage to the scan electrode during electroluminescence timing.

Consequently, because voltage supplied to the scan electrode drive circuit can be lowered by an amount corresponding to the first offset voltage relative to prior art devices, the necessary breakdown voltage of the scan electrode drive circuit can be reduced.

Preferably, the circuit supplies a modulation voltage to set electroluminescence/non-electroluminescence of an EL element and a second offset voltage which is higher than ground level to a data electrode drive circuit, where the data electrode drive circuit, in the negative field, with respect to a data electrode of an EL element in an electroluminescent state, sets voltage thereof at the modulation voltage, and with respect to a data electrode of an EL element in a non-electroluminescent state, sets voltage thereof at the second offset voltage.

Consequently, because voltage supplied to the data electrode drive circuit can be lowered by an amount corresponding to the second offset voltage than in a device according to the prior art, the necessary breakdown voltage of the data electrode drive circuit can be reduced.

Such a circuit need not be limited to use with matrix-type EL displays and may also be used in EL display devices which perform segmented display, backlighting or the like.

It is another object of the present invention to provide an EL display drive circuit which uses a single power source to apply a positive and negative alternating current voltage to an EL element when outputting alternating current voltage to a load such as an EL element or the like, without employing two types of positive and negative power sources.

This object is attained according to another aspect of the invention by providing a first switching device to open and close a connection between a positive electrode of a power source and a first reference voltage and a second switching device to open and close a connection between a negative electrode of the power source and a second reference voltage to be alternatively actuated in accordance with a control signal, and further to select a voltage of the power source positive electrode and negative electrode and to perform output for driving a load.

Because of this, voltage of negative polarity with a magnitude of the first reference voltage is created by the negative electrode of the power source when the first switching device has been actuated, and voltage of positive polarity with a magnitude of the second reference voltage is created by the positive electrode of the power source when the second switching device has been actuated.

Consequently, by selecting and outputting the created voltage, an alternating current signal is output and a load such as an EL element or the like can be driven by the output.

It is another object of the present invention to provide a circuit to perform charge collection and rise in voltage to at least two stages, and moreover, to stabilize the applied voltage at a time of collected charge reuse without being affected by an amount of accumulated capacitor charge.

This object is attained according to another aspect of the present invention by providing a circuit in which charging of an EL display element by a charge collected by a charge collecting capacitor is performed and a predetermined voltage is applied to the EL display element prior to electroluminescence drive for the EL display element, and thereafter, during electroluminescence drive, power source voltage (modulation voltage) is applied directly to the EL display element and a voltage rise is performed, and electroluminescence drive of the EL display element is performed. Subsequently to electroluminescence drive, charge stored in the EL display element is collected in the capacitor for charge collecting use.

Consequently, by structuring the device so that power source voltage (modulation voltage) is applied directly to the EL display element and a voltage rise is performed during electroluminescence drive, no need exists to create voltage corresponding to a power source voltage positive capacitor charging, and so the structure of a circuit for this purpose can be simplified, and moreover, applied voltage at a time of collected charge reuse can be stabilized without being affected by an amount of accumulated capacitor charge by directly applying a power source voltage.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 3A–3M are timing diagrams for the device shown in FIG. 1;

FIGS. 6A–6C are timing diagrams showing the operation of the device shown in FIG. 5;

FIG. 7 is a block diagram of a third preferred embodiment of the present invention used for driving a segmented EL display;

FIG. 10 is a schematic diagram of a data voltage supply circuit according to a fifth preferred embodiment of the present invention;

FIGS. 11A–11E are timing diagrams of drive signals in the fifth embodiment;

FIGS. 14A–14O are timing diagrams of drive signals in the sixth embodiment;

DETAILED DESCRIPTION OF THE PRESENTLY PREFERRED EXEMPLARY EMBODIMENTS

Figure 2:
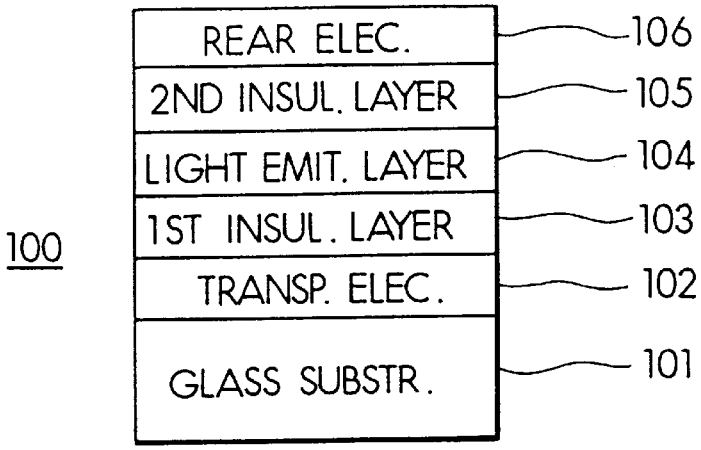
FIG. 2 is a cross-sectional view showing the structure of an EL element.

FIG. 2 shows a typical cross-sectional structure of an EL display. An EL element 100 is formed by laminating on a glass substrate 101 the following: a transparent electrode 102, a first insulating layer 103, a light emitting layer 104, a second insulating layer 105, and a rear electrode 106, and emits light responsive to an alternating current pulse applied between the transparent electrode 102 and the rear electrode 106. Accordingly, in FIG. 2, light is emitted through this glass substrate 101. Further, light can be emitted in both the upper and lower directions in the drawing when the rear electrode 106 is transparent.

Figure 1:
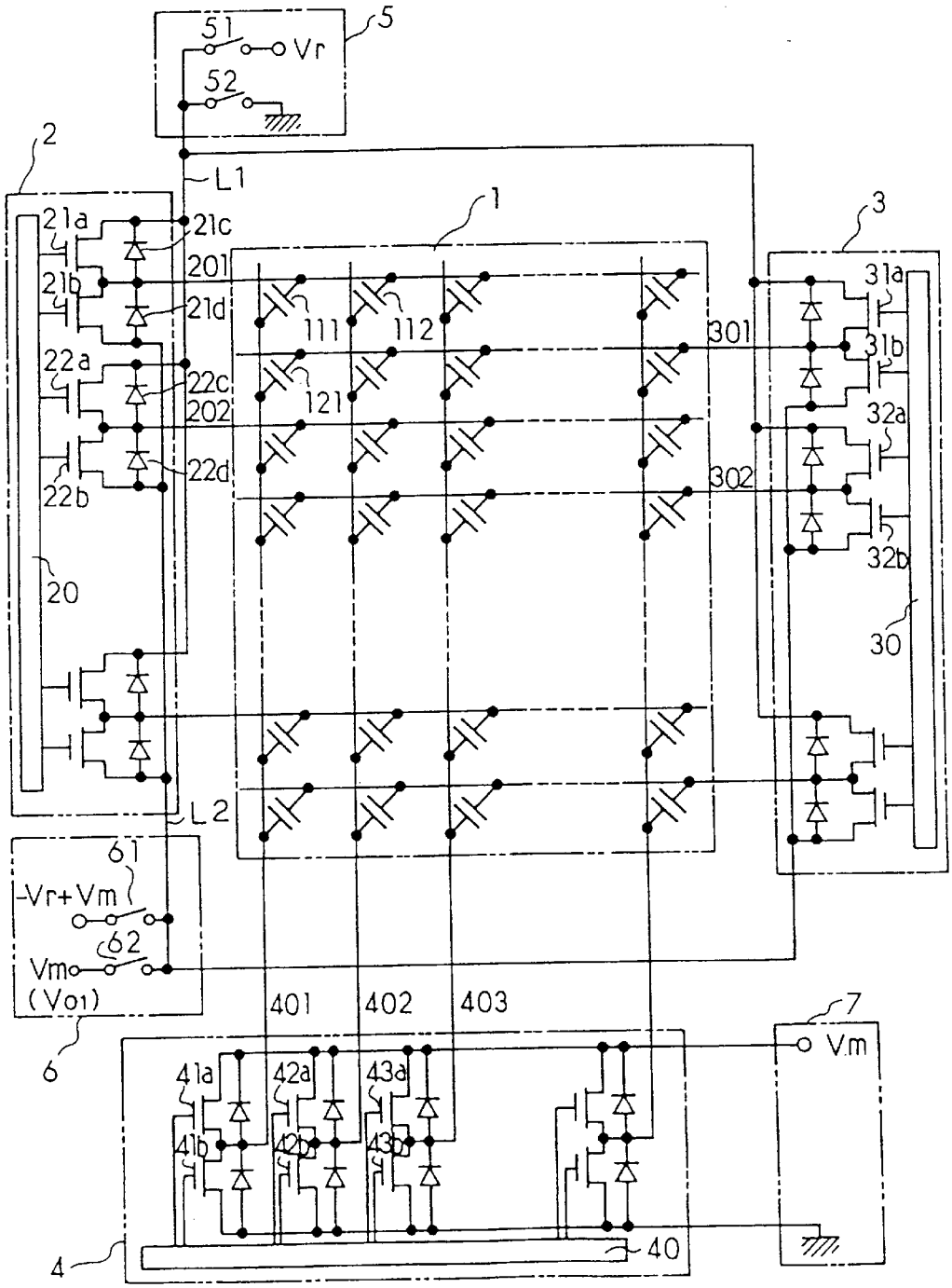
FIG. 1 is a schematic diagram of an EL display device drive circuit according to a first preferred embodiment of the present invention.

FIG. 1 shows an overall structure of an EL display device according to a first embodiment of the present invention. In this Figure, an EL display panel 1 has a plurality of transparent electrodes and back electrodes in columns and rows as scan electrodes and data electrodes, and is structured to perform matrix display.

In specific terms, as shown in FIG. 1, odd-numbered scan electrodes 201, 202, 203, etc. and even-numbered scan electrodes 301, 302, etc. are formed along the column direction of the display, and data electrodes 401, 402, 403, etc. are formed along the row direction of the display 1.

EL elements 111, 112, etc. are formed as pixels at intersections of the scan electrodes 201, 301, 202, 302, etc. and the data electrodes 401, 402, 403, etc. The EL elements are capacitive elements and are represented by capacitor symbols in the Figure.

Scan side driver ICs 2 and 3 and a data side driver IC 4 are provided to perform display drive for this EL display panel 1.

The scan side driver IC 2 is a push-pull type drive circuit having P-channel FETs 21*a*, 22*a*, etc. and N-channel FETs 21*b*, 22*b*, etc. connected to the odd-numbered scan electrodes 201, 202, etc. and applies scan voltage to the odd-numbered scan electrodes 201, 202, etc. in accordance with output from a control circuit 20.

Additionally, parasitic diodes 21*c*, 21*d*, 22*c*, 22*d*, etc. are formed in each of the FETs 21*a*, 21*b*, 22*a*, 22*b*, etc. to establish the voltage of the scan electrodes at a desired reference voltage.

The scan side driver IC 3 has a similar structure, having a control circuit 30, P-channel FETs 31*a*, 32*a*, etc. and N-channel FETs 31*b*, 32*b*, etc. and supplies scanning voltage to the even-numbered scan electrodes 301, 302, etc.

The data side driver IC 4 also has a control circuit 40, P-channel FETs 41*a*, 42*a*, etc. and N-channel FETs 41*b*, 42*b*, etc. and supplies data voltage to the data electrodes 401, 402, 403, etc.

Scan voltage supply circuits 5 and 6 are provided to supply scan voltages to the scan side driver ICs 2 and 3. The scan voltage supply circuit 5 has switching elements 51 and 52 and, in accordance with on/off states thereof, supplies a DC voltage Vr or ground to a P-channel FET source side common line L1 in the scan side driver ICs 2 and 3.

The scan voltage supply circuit 6 has switching elements 61 and 62 and, in accordance with on/off states thereof, supplies a direct current voltage -Vr+Vm or an offset voltage $V_{01}$ to an N-channel FET source side common line L2 in the scan side driver ICs 2 and 3. According to this embodiment, $V_{01}$ is taken to be a modulation voltage Vm, and so will be described as Vm hereinafter.

Additionally, a data voltage supply circuit 7 is provided with respect to the data side driver IC 4. The data voltage supply circuit 7 supplies a direct current voltage Vm to a P-channel FET source side common line of the data side driver IC 4 and supplies a ground voltage to an N-channel FET source side common line of the data side driver IC 4.

According to the above-described structure, it is necessary to apply an alternating current pulse voltage between the scan electrode and the data electrode so that the EL element emits light, and because of this, a pulse voltage whose polarity reverses in each field is provided at each of the several scan lines to drive the display. Operation in positive and negative fields will be described hereinafter with reference to the timing diagrams shown in FIGS. 3A–3M.

In the positive portion of the field, the switching elements 51 and 62 are switched on, and the switching elements 52 and 61 are switched off. At this time, the reference voltage of the scan electrodes 201, 301, 202, 302, etc. becomes offset voltage Vm due to operation of the parasitic diodes of the FETs of the scan side driver ICs 2 and 3. Additionally, the FETs 41*a*, 42*a*, 43*a*, etc. of the data side driver IC 4 are switched on, and voltage of the data electrodes is Vm. In this state, voltage applied to all EL elements becomes 0 V, and so the EL elements do not emit light.

Thereafter, electroluminescence operation in the positive field is started. Firstly, the P-channel FET 21*a* of the scan side driver IC 20 connected to the scan electrode 201 of the first column is switched on, and voltage of the scan electrode 201 is set to Vr. Additionally, output stage FETs of the scan side driver ICs 2 and 3 connected to other scan electrodes are all switched off, and these scan electrodes enter a floating state.

Additionally, among the data electrodes 401, 402, 403, etc., a P-channel FET of the data side driver IC 4 connected to a data electrode of an EL element to emit light is switched off and an N-channel FET thereof is switched on, and a P-channel FET of the data side driver IC 4 connected to a data electrode of an EL element to not emit light is switched on and an N-channel FET thereof is switched off.

Because of this, the data electrode of the EL element to emit light is grounded, and so the voltage Vr being a threshold voltage or more is applied to the EL element and the EL element emits light. Additionally, the voltage Vm of the data electrode of the EL element to not emit light remains unchanged at Vm, and a voltage of Vr−Vm is applied to that EL element.

This voltage of Vr−Vm is lower than the threshold voltage; thus, that EL element does not emit light.

Figures 3C, 3D, 3E, 3F, 3G, 3H, 3I, 3J, 3K:
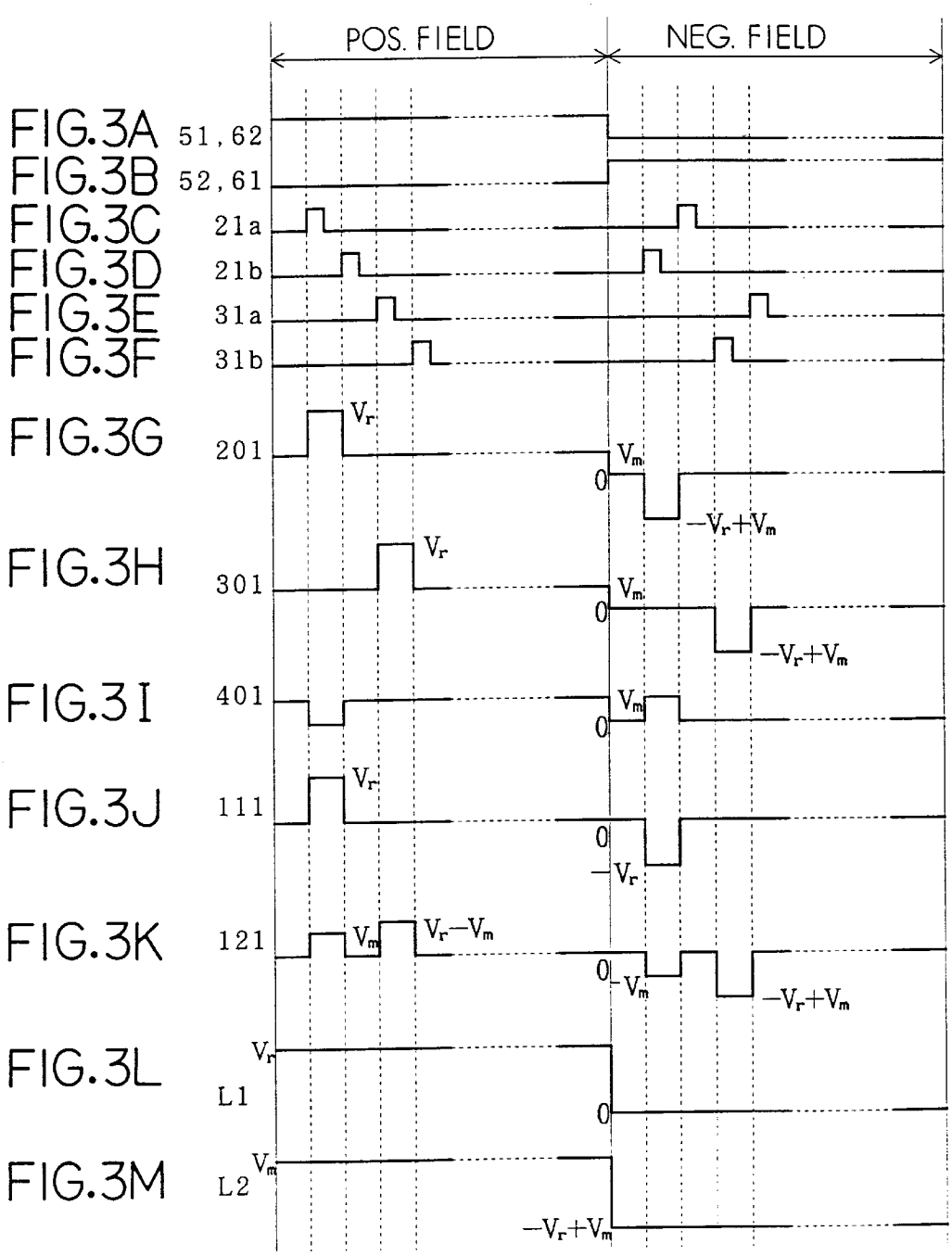

The timing diagram of FIG. 3I shows a state where the P-channel FET 41*a* of the data side driver IC 4 is switched off and the N-channel FET 41*b* thereof is switched on, and FIG. 3J shows a state wherein voltage Vr is applied to the EL element 111 and the EL element 111 emits light.

Thereafter, charge accumulated in the EL element on the scan electrode 201 is discharged by switching off the P-channel FET 21*a* of the scan side driver IC 2 connected to the scan electrode 201 of the first column, and switching on the N-channel FET 21*b* thereof as shown in FIGS. 3C and 3D.

Next, the P-channel FET 31*a* of the scan side driver IC 3 connected to the scan electrode 301 is turned on, and the voltage of the scan electrode 301 is set to Vr as shown in FIG. 3H. Additionally, output stage FETs of the scan side driver ICs 2 and 3 connected to other scan electrodes are all switched off, and these scan electrodes enter a floating state.

Additionally, driving of the EL elements of the second column is performed similarly to the foregoing by setting the voltage levels of the data electrodes 401, 402, 403, etc. to levels corresponding to an EL element to emit light and to an EL element to not emit light.

The timing diagram of FIG. 3I shows a state where the P-channel FET 41*a* of the data side driver IC 4 is switched on, the N-channel FET 41*b* thereof is switched off and the voltage of the data electrode 401 is Vm, and that of FIG. 3K shows that voltage Vr−Vm is applied to the EL element 121 and the EL element 121 does not emit light.

Thereafter, charge accumulated in the EL element on the scan electrode 301 is discharged by switching off the P-channel FET 31*a* of the scan side driver IC 3 connected to the scan electrode 301 of the second column and switching on the N-channel FET 31*b* thereof.

Thereafter, line-sequential scanning, wherein the above-described operation is repeated until the final scan line is reached, is performed similarly.

In the negative field portion, the switching elements 52 and 61 are switched on, the switching elements 51 and 62 are switched off, and operation similar to the operation in the positive field is performed with reversed polarity. At this time, reference voltage of the scan electrodes 201, 301, 202, 302, etc. goes to ground. Additionally, the FETs 41*b*, 42*b*, 43*b*, etc. of the data side driver IC 4 are switched on, and voltage of the data electrodes is set to ground. In this state, the voltage applied to all EL elements becomes 0 V, and so the EL elements do not emit light.

Thereafter, line-sequential scanning similar to that done in the positive field is performed for the negative field as well.

−Vr+Vm is applied to the scan electrode of the column where display selection is performed. On the data electrode side, oppositely to the positive field, voltage of a data electrode to emit light is set to Vm, and voltage of a data electrode which is to not emit light is remains at ground.

Consequently, when voltage Vm is applied to a data electrode with respect to a scan electrode to which a voltage of −Vr+Vm is applied, a voltage of −Vr is applied to an EL element corresponding thereto, and the EL element emits light. Furthermore, when voltage of a data electrode is ground voltage, a voltage of −Vr+Vm, which is lower than the threshold voltage, is applied to the EL element, and so the EL element does not emit light.

Accordingly, one cycle of display operation is completed by drive of the above-described positive and negative fields, and this is performed repeatedly.

As is understood from the above-described operation, a voltage of Vr−Vm is applied to the scan side driver ICs 2 and 3 in both the positive and negative fields. Consequently, the necessary breakdown voltage of the scan side driver ICs 2 and 3 can be lowered by an amount corresponding to the second offset voltage in comparison with prior art devices, and breakdown voltage of the scan side driver ICs 2 and 3 can be reduced.

Moreover, because a change from offset voltage Vm to voltage Vr for drive use is used in the positive field, the voltage change thereof can be smaller, peak current flowing to the EL element can be lowered, and reliability of the EL element can be improved.

Figure 4:
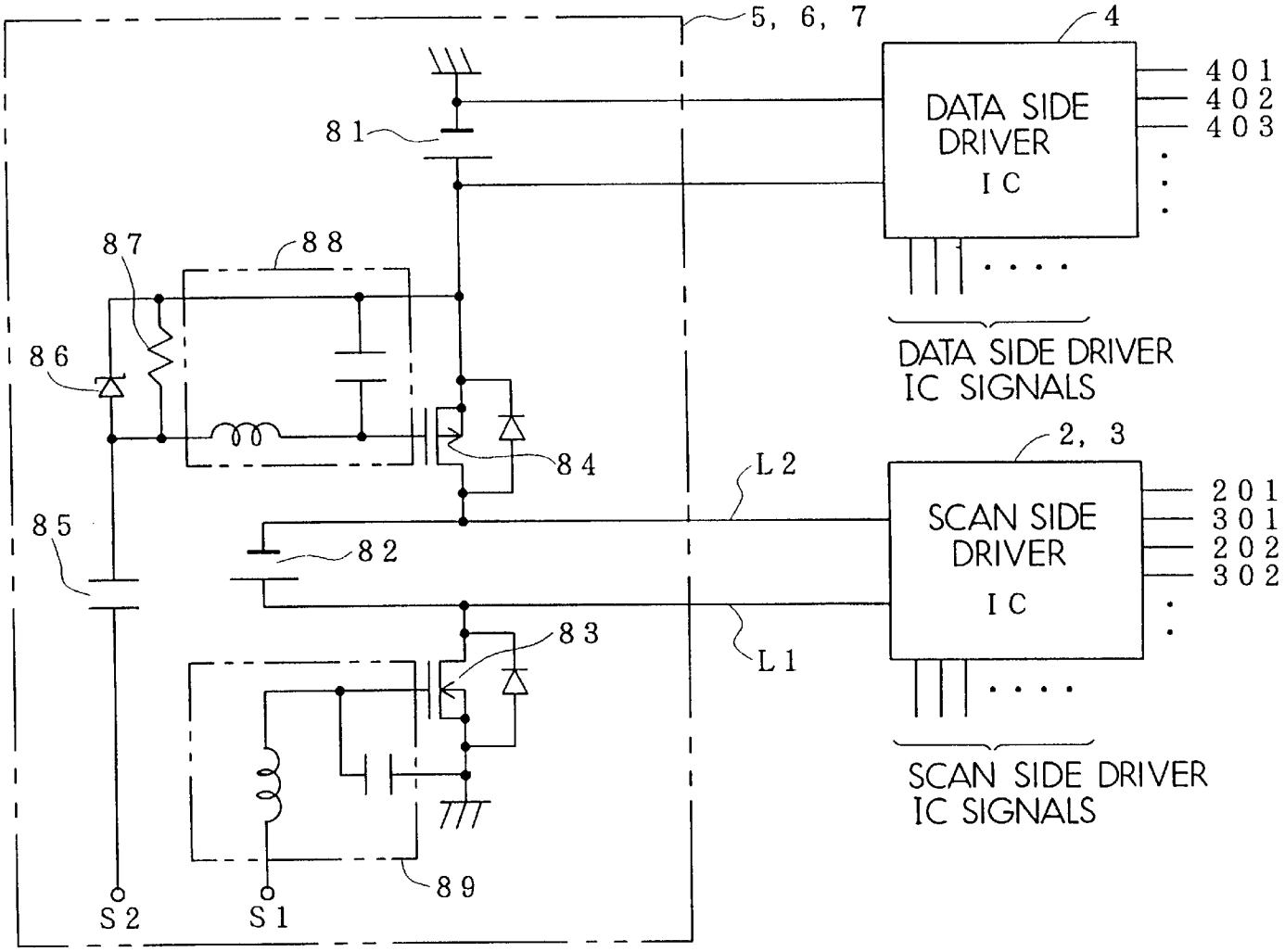
FIG. 4 is a schematic diagram showing a specific structure of a voltage supply circuit according to the first embodiment.

Specific structures of the scan voltage supply circuit 6 and data voltage supply circuit 7 will be described below. A circuit where the switches 51 and 61 can be omitted due to utilization of a power source of (Vr−Vm) is shown in FIG. 4.

In this Figure, voltage supply circuits 5 through 7 are provided with a first power source 81 having a voltage of Vm and a second power source 82 having a voltage of Vr−Vm, and the positive terminal of the first power source 81 and the negative terminal of the second power source 82 are connected via a P-channel FET 84 (i.e., a second switching device as recited in the appended claims). Additionally, the positive electrode of the second power source 82 is grounded via an N-channel FET 83 (i.e., a first switching device as recited in the appended claims).

A control signal is provided to the P-channel FET 84 from an input terminal S2 via a coupling capacitor 85, input protection Zener diode 86, resistor 87, and filter circuit 88.

Additionally, a control signal is provided to the N-channel FET 83 from an input terminal S1 via a filter circuit 89.

When in the positive field, low level control signals are provided to both input terminals S1 and S2, and the N-channel FET 83 is switched off and the P-channel FET 84 is switched on. At this time, a voltage Vm of the first power source 81 is output from the negative electrode of the second power source 82 to a negative electrode voltage supply line L2 as an offset voltage, and a voltage Vr (=Vr−Vm+Vm) is output to the positive electrode voltage supply line L1 from the positive electrode of the second power source 82.

Additionally, voltages Vm and 0 V are respectively supplied to the data side driver IC 4 from the positive and negative electrodes of the first power source 81.

Consequently, the drive voltage in the positive field is created by the above-described voltages.

Furthermore, according to the structure shown in FIG. 4, a control signal for scan side driver IC drive use is provided to the scan side driver ICs 2 and 3 via an isolation circuit (not illustrated), and line sequential scanning of the scan side driver ICs is performed. The isolation circuit performs a level shift at a time of signal transmission between circuits having differing reference potentials, and functions to convey logic levels correctly.

Additionally, display data is output according to a control signal from the data side driver IC 4.

Figure 5:
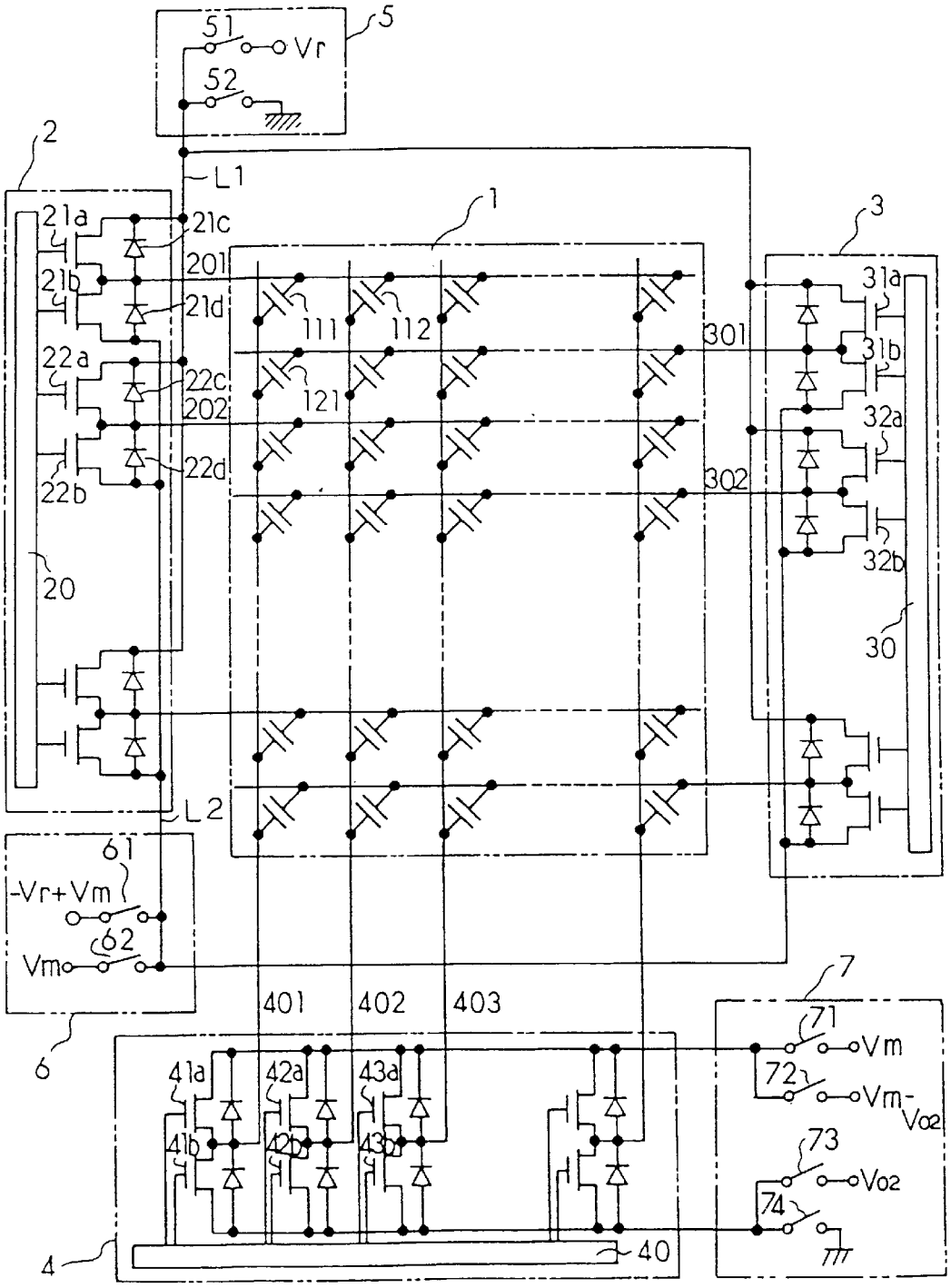
FIG. 5 is a schematic diagram of an EL display device according to a second preferred embodiment of the present invention.

In the foregoing first embodiment, lowering of breakdown voltage with respect to the scan side driver ICs 2 and 3 was provided, but according to a second preferred embodiment of the present invention, lowering of breakdown voltage with respect to the data side driver IC 4 as well is provided. The overall structure of this embodiment is shown in FIG. 5.

In this Figure, the data voltage supply circuit 7 selectively outputs four voltages Vm, $Vm-V_{02}$, $V_{02}$, and 0 V in accordance with operation of switching elements 71 through 74.

That is to say, in the positive field, switching elements 72 and 74 are switched on and switching elements 71 and 73 are switched off, and voltages $Vm-V_{02}$ and 0 V are supplied to the data side driver IC 4.

Herein, the EL element emits light when a voltage Vr is applied to the scan electrode and a voltage of 0 V is applied to the data electrode during electroluminescence timing.

Additionally, when a voltage of $Vm-V_{02}$ is applied to the data electrode, the voltage on the EL element is $Vr-Vm+V_{02}$, which is not sufficient for it to emit light. The EL element can be set in a non-electroluminescent state by establishing a voltage thereof at a voltage which is lower than an electroluminescence threshold voltage of the EL element.

Moreover, in the negative field, the switching elements 71 and 73 are switched on and switching elements 72 and 74 are switched off, and voltages Vm and $V_{02}$ are supplied to the data side driver IC 4.

In this case, the EL element emits light when the voltage of the data electrode is Vm during electroluminescence timing when voltage of −Vr+Vm has been applied to the scan electrode. Additionally, voltage of $-Vr+Vm-V_{02}$ is applied to the EL element when voltage of the data electrode is $V_{02}$, but because this voltage has been established at a voltage which is lower than the electroluminescence threshold voltage of the EL element, as was described above, the EL element is in a non-electroluminescent state.

Consequently, an EL element can selectively emit light in a positive field, similarly to the above-described first embodiment.

According to the foregoing structure, a voltage of $Vm-V_{02}$ is applied to the data side driver IC 4 in the positive field. Consequently, the breakdown voltage of the data side driver IC 4 can be reduced by an amount corresponding to offset voltage $V_{02}$.

Furthermore, according to this second embodiment, lowering of breakdown voltage with respect to both the scan side driver ICs 2 and 3 and the data side driver IC 4 was provided, but it is also acceptable to lower the breakdown voltage with respect to only the data side driver IC 4 if such is necessary.

Additionally, as shown in FIGS. 6A–6C, when ½ of modulation Vm is taken as the offset voltage $V_{02}$, a differential voltage applied to the EL element during electroluminescence and during non-electroluminescence can be optimized.

According to the above-described embodiments, a device to perform matrix display where a plurality of scan electrodes and a plurality of data electrodes are mutually perpendicular was described, but this invention can be applied also in a device to perform segmented display. In this case, it is sufficient to perform control so that positive and negative drive voltage pulses are applied to each segment with respect to the device shown by the timing diagrams of FIGS. 3A–3M without performing a shift in scan voltage. That is, in the positive field, an offset voltage Vm is applied as a reference voltage to one electrode, together with applying a voltage Vr during electroluminescence timing, and a ground voltage is applied to the other electrode for electroluminescence, or voltage Vm (or $Vm-V_{02}$ as in the second embodiment) is applied to the other electrode in a case of no electroluminescence. Additionally, in the negative field, ground voltage is applied as a reference voltage to one electrode, together with applying a voltage −Vr+Vm during electroluminescence timing, and a voltage Vm is applied to the other electrode in a case of electroluminescence, or a ground voltage (or voltage $V_{02}$ as in the second embodiment) is applied to the other electrode in a case of no electroluminescence.

A block structure of this embodiment is shown in FIG. 7. In this Figure, a voltage supply circuit 140 supplies the foregoing voltages of Vr, Vm, and −Vr+Vm and ground voltage to a first drive circuit 120, and supplies the foregoing voltages of Vm, ground voltage, and so on to a second drive circuit 130. The first drive circuit 120 applies voltages which differ in the above-described positive and negative field to one electrode 102 of the EL element 100, and the second drive circuit 130 applies the foregoing voltages to another electrode 106 thereof.

Figure 8:
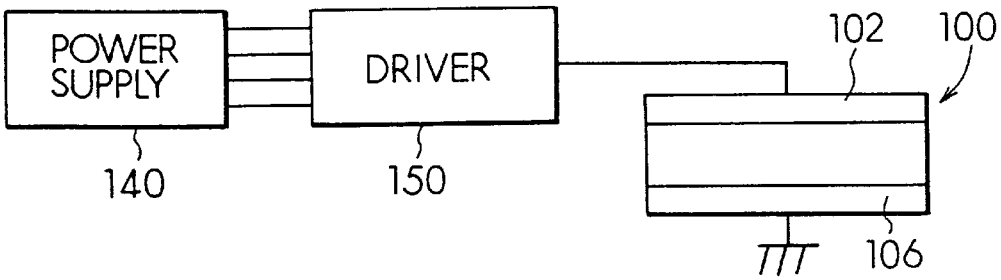
FIG. 8 is a block diagram showing a fourth preferred embodiment of the present invention as used in a backlight EL display.

In another preferred embodiment, one electrode is grounded while positive and negative drive voltage pulses are applied to the other electrode. The structure of the latter case is shown in FIG. 8.

Figure 9:
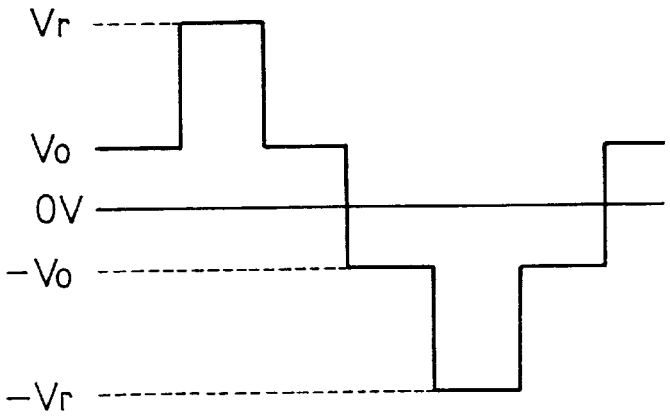
FIG. 9 is a drive waveform diagram of the embodiment shown in FIG. 8.

In this Figure, voltage supply circuit 140 outputs a voltage of ±Vr and an offset voltage of $\pm V_0$ to a drive circuit 150. The drive circuit 150 applies an alternating current voltage having offset voltage $V_0$ to another electrode of the EL element 100, as shown in FIG. 9. In this case, the breakdown voltage of the drive circuit 150 is established by $Vr-V_0$, and so the breakdown voltage can be lowered by an amount corresponding to offset voltage $V_0$.

Additionally, this invention can be applied also in a case wherein an EL element is utilized as a backlight (i.e., panel electroluminescence).

Furthermore, according to the above-described first and second embodiments, a device utilizing the FETs 21*a*, 31*a*, 41*a*, etc. as switching elements to switch the voltage applied to the several electrodes in the several driver ICs 2 through 4 was described, but devices other than FETs, e.g, thyristors, bipolar transistors, and the like, can be employed as switching elements.

The data voltage supply circuit 7 shown in FIG. 5 is a variation on the power source circuit shown in FIG. 10. This circuit has a single power source 91, and is structured so that a positive electrode thereof is grounded via an N-channel FET 92 (a first switching device) and a negative electrode thereof is grounded via a P-channel FET 93 (a second switching device). Additionally, a smoothing capacitor 94 is provided in parallel with this power source 91.

A control signal is input to the N-channel FET 92 from an input terminal S1', and a control signal is input to the P-channel FET 93 from an input terminal S2' via a coupling capacitor 95. Zener diodes 96 and 97 and a resistor 98 are provided for input protection.

An output circuit 99 is provided in an output stage of the power source circuit, and output voltage thereof is applied to one electrode of an EL element 100. The other electrode of the EL element 100 is grounded.

Operation of the above-described structure will be described hereinafter with reference to the graphs shown in FIGS. 11A–11E.

High level and low level control signals are input to the input terminals S1' and S2', as shown in FIGS. 11A and 11B.

When the control signals are both low level, the N-channel FET 92 is switched off and the P-channel FET 93 is switched on. Consequently, voltage V of the power source 91 is output to the positive terminal and ground is output to the negative terminal.

Additionally, when the control signals are both high level, the N-channel FET 92 is switched on and the P-channel FET 93 is switched off. Consequently, ground voltage is output to the positive terminal and −V voltage is output to the negative terminal.

Meanwhile, the output circuit 99 is interlocked with the control signals and is alternatingly switched to a switch state of T1 or T2 at a timing shown in FIG. 11E. Accompanying this switching, the alternating current voltage of FIG. 11E according to ±V voltage and ground voltage is output. This alternating current voltage is applied to one side of the EL element 100, and so the EL element 100 emits light.

When S1' and S2' are high level, the N-channel FET 92 is switched on, and so when T1 is on at this time, output is to GND. When S1' and S2' go low, the P-channel FET 93 is switched on, and so T1 remains unchanged and output goes to V. When switching on from T1 to T2 occurs with S1' and S2' remaining unchanged, output goes to ground and current from the EL element load flows from T2 through the parasitic diode of the FET 93 to GND. Output times (pulse widths) $T_P$ and $T_N$ for which voltage is output are determined according to switching timing of the switches T1 and T2 and change in the state of S1' and S2'.

Figure 12:
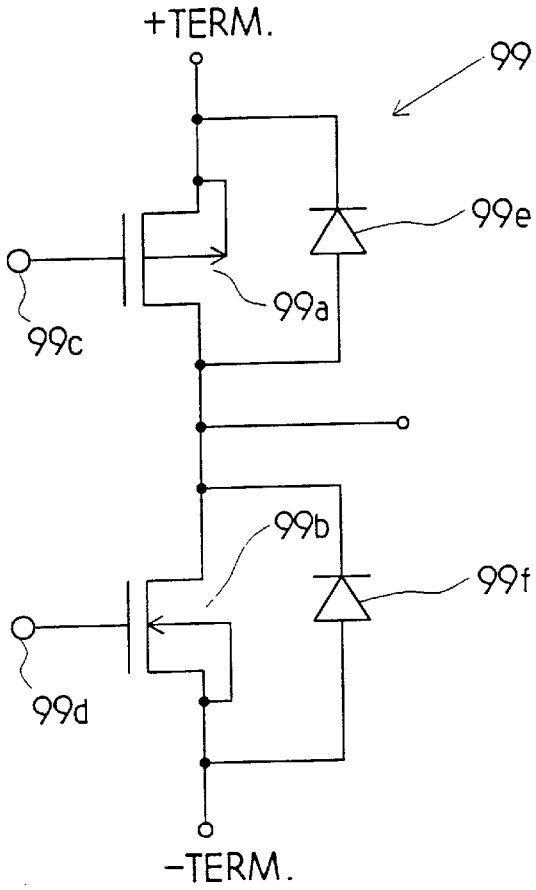
FIG. 12 is a schematic diagram of an output circuit in the fifth embodiment.

A specific structure of the output circuit 99 is shown in FIG. 12, where the output circuit 99 has a P-channel FET 99*a* and an N-channel FET 99*b*, and is structured to switch on one FET or the other and output either a positive terminal or a negative terminal voltage in accordance with high level and low level signals (signals interlocked with control signals input to input terminals S1' and S2') from input terminals 99*c* and 99*d*. Further, 99*e* and 99*f* in the drawing are parasitic diodes.

The above-described embodiment is a device to output ±V as an alternating current signal, taking ground voltage as a reference, but when voltage connected to the power source 91 via the FETs 92 and 93 is a second power source to generate a predetermined reference voltage rather than ground voltage, alternating current voltage centering on this reference voltage can be output. In this case, the EL element 100 can emit light similarly to the above-described embodiment when voltage identical to the foregoing reference voltage is applied to the other electrode of the EL element.

The circuit described above is used as an EL element drive circuit, but it can be applied to drive any load, including a load other than an EL element, which is actuated by receiving positive and negative alternating current voltage from a single output line. In this case, it is acceptable for the device to selectively output a created positive and negative voltage by push-pull operation and drive a load.

Additionally, the driver circuit described above is a push-pull device connecting a P-channel FET and an N-channel FET, but a push-pull driver of solely N-channel FETs is also acceptable. It is also acceptable to utilize NPN and PNP bipolar transistors respectively in place of the N-channel FET 92 and P-channel FET 93.

Figure 13:
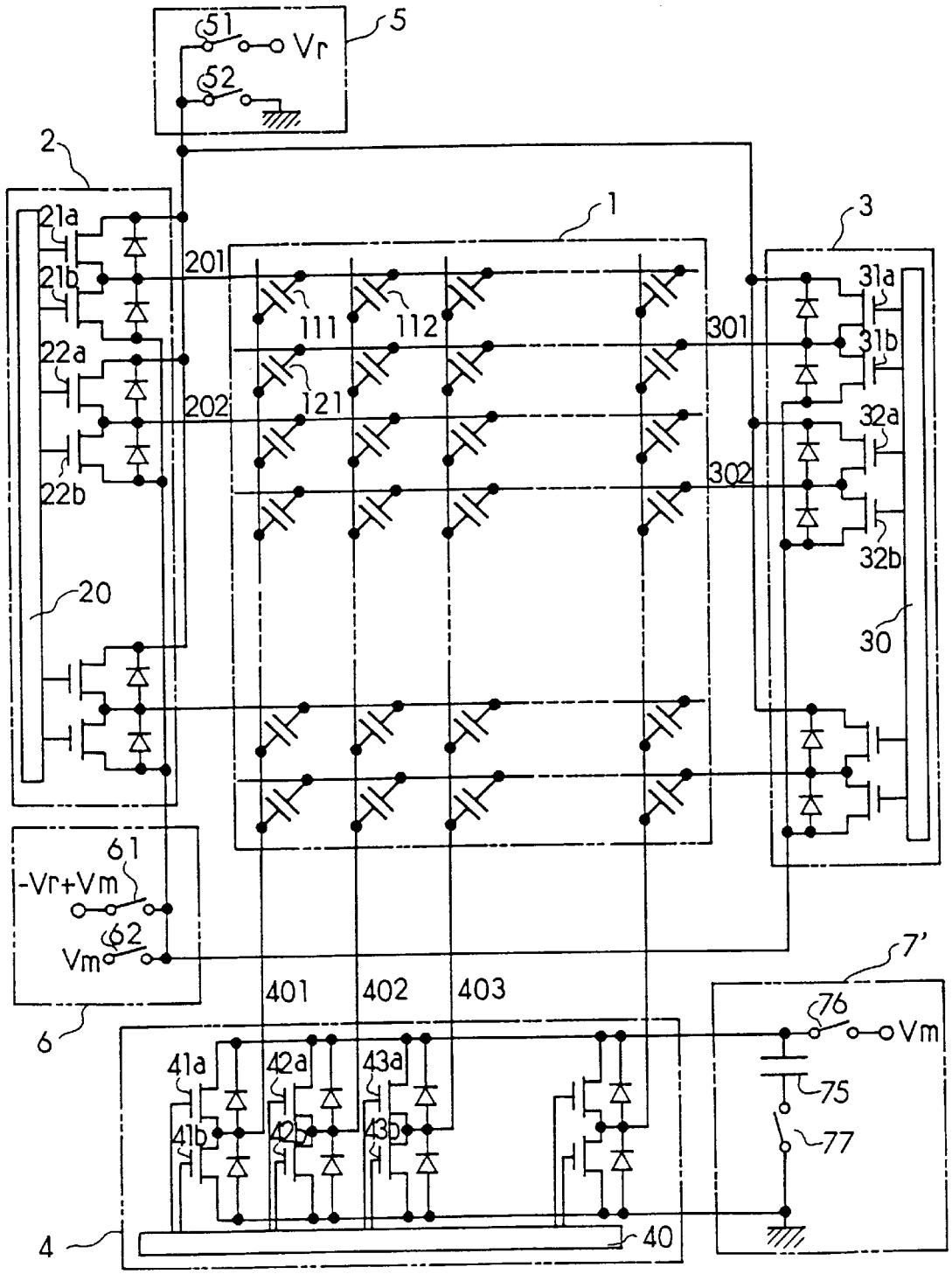
FIG. 13 is a schematic diagram of an EL display element drive circuit according to a sixth embodiment of the present invention.

FIG. 13 shows another embodiment of the present invention in which a data voltage supply circuit 7' includes a charge collecting capacitor 75 and switching elements 76 and 77, and Vm is utilized as a power source voltage. The charge capacity of the charge collecting capacitor 75 is sufficiently large in comparison with charge capacity of the entirety of the EL display panel 1.

Operation in first and second fields according to this embodiment will be described hereinafter with reference to the timing diagrams of FIGS. 14A–140.

The charge collecting capacitor 75 is charged with a charge of Vm/2 , i.e., half of modulation voltage Vm, as an initial state. This is because an amount of capacitor charge accumulation converges to an equivalent of Vm/2 due to repeatedly performing drive which will be described hereinafter.

Initialization is performed at a start of operation of this first field. That is to say, switching elements 51 and 62 are switched on, switching elements 52 and 61 are switched off, and voltages on all scan electrodes are set to Vm. Additionally, switching element 76 is switched off and switching element 77 is switched on, and along with this, all P-channel FETs of a data side driver IC 4 are switched on and voltages on all data electrodes are Vm/2.

Subsequent to this initialization, source voltage of the P-channel FETs of the data side driver IC 4 becomes Vm/2. Herein, the N-channel FET of the data side driver IC 4 connected to the data electrode of an EL element to emit light is switched on, the P-channel FET thereof is switched off, the P-channel FET of the data side driver IC 4 connected to the data electrode of an EL element not to emit light is switched on, and the N-channel FET thereof is switched off. At this time, voltage of the data electrode of an EL element to emit light becomes Vm/2, and voltage of the data electrode of an EL element to emit light becomes 0.

Next, the P-channel FET 21*a* of the scan side driver IC 2 connected to the scan electrode 201 of the first column is switched on, and voltage of the scan electrode 201 is set to Vr. Simultaneously thereto, the switching element 76 is switched on and the switching element 77 is switched off, and power source voltage Vm is applied to the data electrode of the P-channel FET of the data side driver IC 4 which was switched on, i.e., to the data electrode of the EL element not to emit light.

At this time, a voltage of Vm−Vr is applied to the EL element not to emit light, and so the EL element does not emit light, but voltage Vr is applied to the EL element to emit light and the EL element emits light.

Figures 14C, 14D, 14E, 14F, 14G, 14H, 14I, 14J, 14K, 14L, 14M, 14N, 14O:
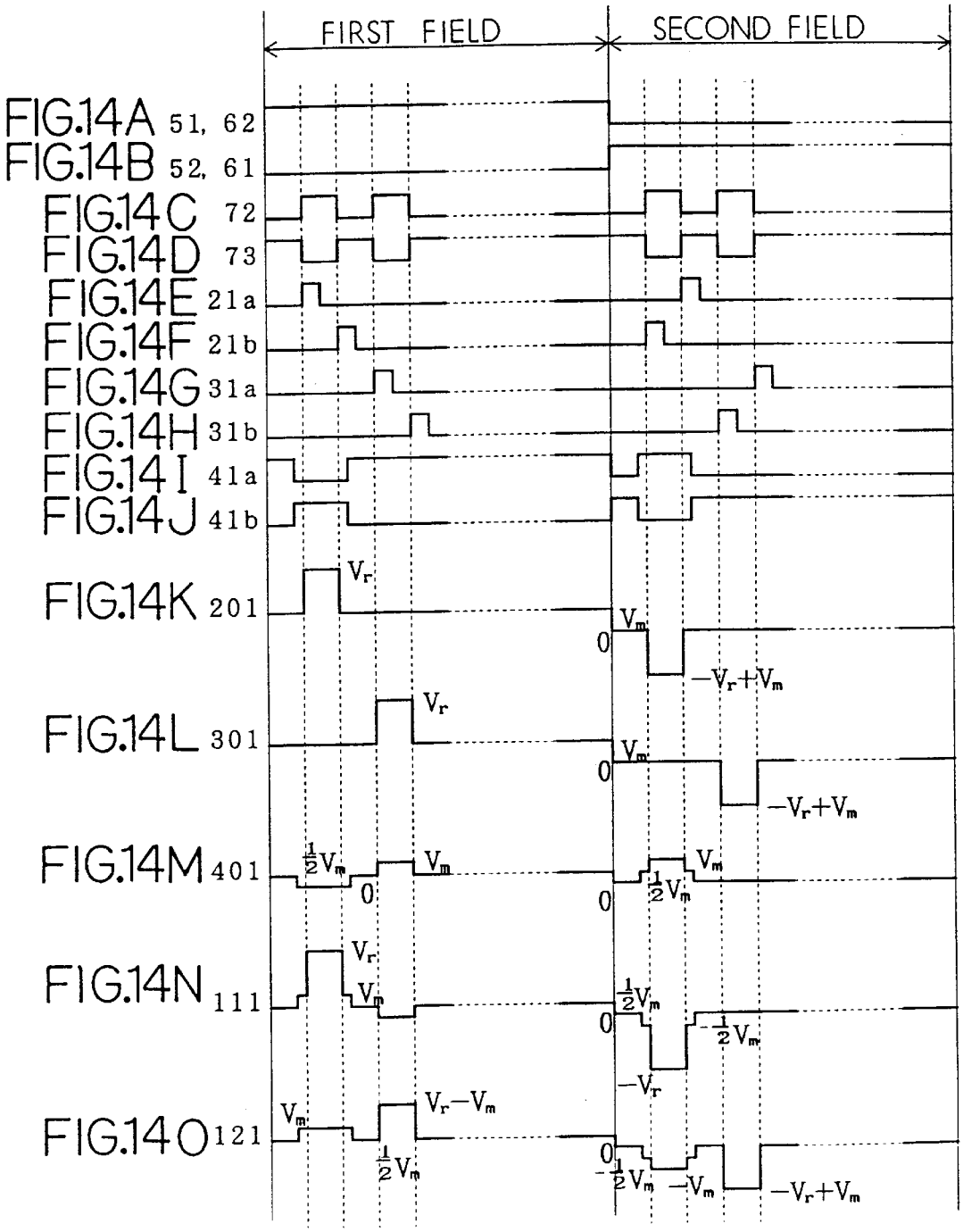
Figures 16A, 16B, 16C, 16D, 16E, 16F:
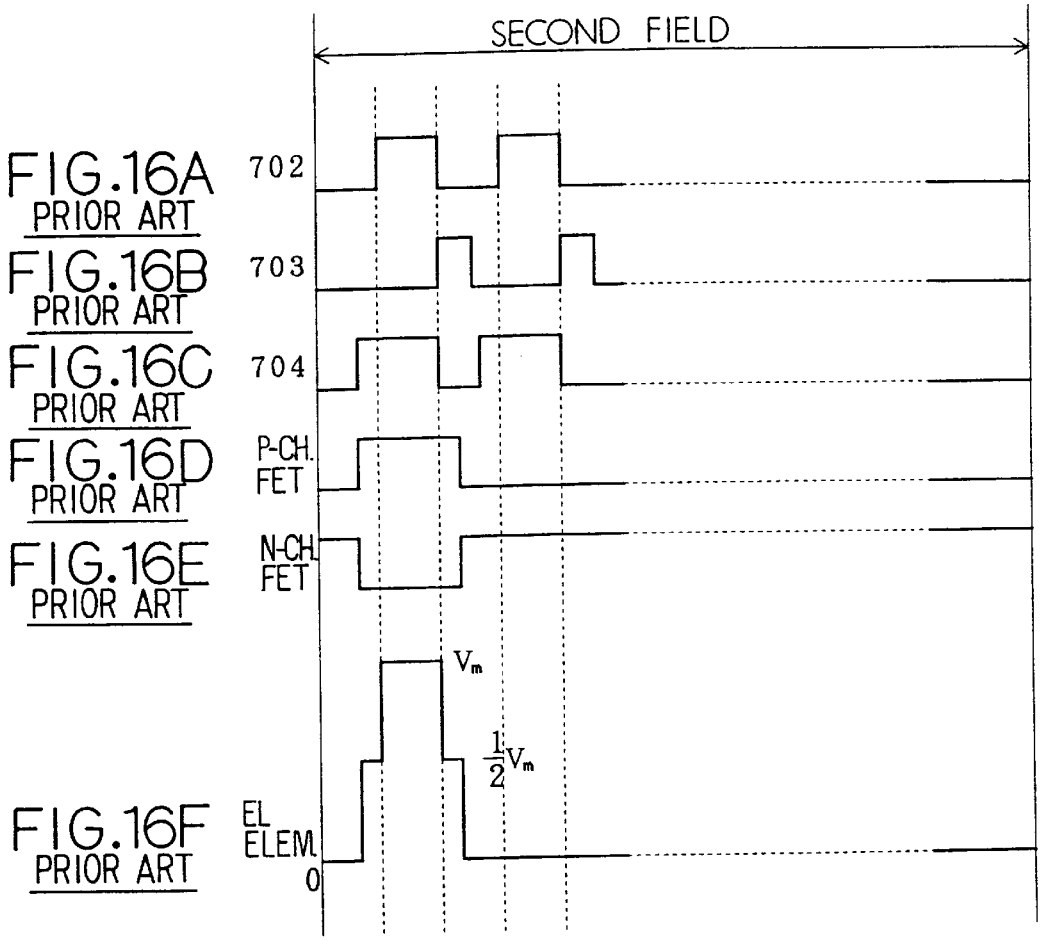
FIG.16A PRIOR ART
FIG.16B PRIOR ART
FIG.16C PRIOR ART
FIG.16D PRIOR ART
FIG.16E PRIOR ART
FIG.16F PRIOR ART
FIGS. 16A–16F are timing diagrams of drive signals in the prior art circuit.

The timing diagram of FIG. 14I shows a state wherein the P-channel FET 41*a* of the data-side driver IC 4 is switched off; FIG. 14J shows that the N-channel FET 41*b* thereof is switched on; FIG. 14M shows that the voltage of the data electrode 401 is 0; FIG. 14N shows that voltage Vr is applied to the EL element 111, and the EL element 111 therefore emits light.

Thereafter, charge accumulated in the EL element on the scan electrode 201 is discharged by switching off the P-channel FET 21*a* of the scan side driver IC 2 connected to the scan electrode 201 of the first column as shown in FIGS. 14E and 14K, and switching on the N-channel FET 21*b* thereof as shown in FIG. 14F.

At this time, half of the charge with which the entirety of the EL display panel 1 has been charged between the data electrodes for which the P-channel FETs of the data side driver IC 4 were switched on and the data electrodes for which the N-channel FETs thereof were switched on by switching off the switching element 76 and switching on the switching element 77 is collected by the capacitor for charge collecting use 75 via the P-channel FETs of the data side driver IC 4.

Charge capacity of the capacitor for charge collecting use 75 is sufficiently large in comparison with charge capacity of the EL elements, and the voltage Vm/2 between terminals remains substantially unchanged.

Finally, voltages on all data side electrodes are set to Vm/2 by switching on all P-channel FETs of the data side driver IC 4.

Operation for the scan lines of the second and following columns is similar to the foregoing. According to the timing diagram of FIG. 14I, at the scan line of the second column, the P-channel FET 41*a* of the data side driver IC 4 is switched on; as shown in FIG. 14J, the N-channel FET 41*b* thereof is switched off; as shown in FIG. 14M, the voltage on the data electrode 401 is set to Vm; voltage Vr−Vm is applied to the EL element 121 as shown in FIG. 140; and the EL element 121 does not emit light.

In the second field, initialization is first performed. That is, after electroluminescence operation for all columns in the first field has been performed, switching elements 51 and 62 are switched off, switching elements 52 and 61 are switched on, voltages on all scan electrodes are set to ground, and along with this, all N-channel FETs of the data side driver IC 4 are switched on, all data electrodes are set to ground, and charge which is the equivalent of approximately Vm/2 accumulated in all elements is discharged. Thus, the voltage on all data electrodes goes to zero.

Additionally, switching element 72 is switched off and switching element 73 is switched on, and the source voltage of the P-channel FETs of the data side driver IC 4 becomes Vm/2.

Herein, the N-channel FET of the data side driver IC 4 connected to the data electrode of an EL element to emit light is switched off, the P-channel FET thereof is switched on, the P-channel FET of the data side driver IC 4 connected to the data electrode of an EL element not to emit light is switched off, and the N-channel FET thereof is switched on.

According to the example in FIG. 13, voltage on the data electrode 401 is Vm/2 by switching on the P-channel FET of the data side driver IC 4 connected to the data electrode 401 as shown in FIG. 14M.

Next, the N-channel FET 21*b* of the scan side driver IC 2 connected to the scan electrode 201 of the first column is switched on as shown in FIG. 14F, and voltage of the scan electrode 201 becomes −Vr+Vm. Simultaneously thereto, the switching element 76 is switched on and the switching element 77 is switched off, and power source voltage Vm is applied to the data electrode (data electrode 401 or the like) of the P-channel FET of the data side driver IC 4 which was switched on as shown in FIG. 14M.

At this time, voltage Vr is applied to an EL element to emit light and the EL element emits light, and voltage of Vm−Vr is applied to an EL element not to emit light and the EL element does not emit light.

Thereafter, charge accumulated in the EL element on the scan electrode 201 is discharged by switching on the P-channel FET 21*a* and switching off the N-channel FET 21*b* as shown in FIGS. 14E and 14F.

At this time, half of the charge with which the entirety of the EL display panel 1 has been charged between the data electrodes for which the P-channel FETs of the data side driver IC 4 were switched on and the data electrodes for which the N-channel FETs thereof were switched on by switching off the switching element 76 and switching on the switching element 77 is collected by the charge collecting capacitor 75 via the P-channel FETs of the data side driver IC 4. The charge capacity of the charge collecting capacitor is sufficiently large in comparison with the charge capacity of the EL elements, and the voltage Vm/2 between terminals remains substantially unchanged.

Finally, voltages on all data side electrodes are set to Vm/2 by switching on all N-channel FETs of the data side driver IC 4.

Operation for the scan lines of the second column and after is similar to the foregoing.

By performing drive as was described above, charge collected in the charge collecting capacitor 75 is used to set the voltage of the data electrode 401 to be Vm/2 prior to an electroluminescence operation at the subsequent scan line. Consequently, power consumption occurs only when the switching element 72 has been switched on, and an amount of output required from the power source Vm is 50% compared with the prior art; that is to say, power consumption becomes 50% in comparison with the prior art.

Figure 15:
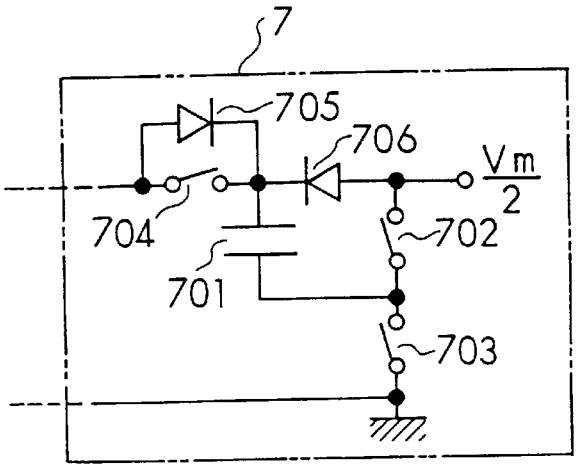
FIG.15 PRIOR ART
FIG. 15 is a schematic diagram of a prior art drive circuit.

According to this embodiment, power source voltage at the data voltage supply circuit 7 is the same voltage as modulation voltage Vm, and so there is no need to create voltage of Vm/2 as with the device according to the prior art shown in FIG. 15, and the power source system can be simplified.

The voltage applied to the scan electrodes in the above embodiment was Vr, −Vr+Vm, or 0, and the voltage applied to the data electrodes was Vm or 0, but this invention is not exclusively limited to such voltages, and it is acceptable, for example, to set the voltage applied to the scan electrodes to be Vr−Vm/2 or −Vr+Vm/2, and to set the voltage applied to the data electrodes to be Vm/2 or −Vm/2.

Additionally, data side applied voltage rose in two stages, but it is also acceptable to provide a plurality of capacitors for charge collecting use and to increase the number of stages. In this case, the effect of reduction of power consumption becomes greater as the number of stages is increased.

Furthermore, the above-described method of EL drive is not exclusively limited to a field reversing drive method, and a field refreshing drive method may alternatively be used.

Still further, a device wherein charge collection is performed from a data electrode side was described, but charge collection from a scan electrode side is also acceptable.

Yet further, this invention is not exclusively limited to a device to drive a matrix-type EL display device, but can be applied also to an EL display device to perform pattern display.

Yet still further, a device utilizing FETs in the output stages of the scan side driver ICs 2, 3, and 4 was described, but output stages utilizing thyristors or bipolar transistors is also acceptable.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A load driving device, comprising:

a power source;

first switching means for opening and closing a connection between a positive electrode of said power source and a first reference voltage; and second switching means for opening and closing a connection between a negative electrode of said power source and a second reference voltage;

wherein said first and second means for switching are alternatively actuated responsive to a control signal, said load driving device further comprising output means for selectively outputting one of a voltage of said power source positive electrode and a voltage of said power source negative electrode as a load driving signal.

2. A load driving device as recited in claim 1, wherein said first and second reference voltages are identical voltages.

3. A load driving device as recited in claim 2, wherein said first and second reference voltages are both ground voltages.

4. A load driving device as recited in claim 1, wherein said first and second reference voltages are different voltages.

5. A load driving device as recited in claim 1, wherein said outputting means includes push-pull drive circuits to selectively output said voltages of said power source positive electrode and said power source negative electrode by push-pull operation.

6. A load driving device as recited in claim 1, wherein said first and second means for switching are each a transistor having a parasitic diode.

7. A driving device for EL device comprising a first power source and a second power source;

a first switch for opening and closing a connection between a positive electrode of said first power source and a reference voltage;

a second switch for opening and closing a connection between a positive electrode of said second power source and a negative electrode of said first power source;

a first driving circuit for applying voltage of positive or negative polarity to one electrode of an EL device and discharging charge accumulated in said EL device; and a second driving circuit for applying a data voltage to the other electrode of said EL device from said a positive electrode of said second power source;

wherein said first switch and said second switch are alternatively actuated responsive to a control signal, wherein said circuit applies voltage of positive polarity to one electrode of said EL device by connecting a positive electrode of said first power source with said one electrode of said EL device, then, discharges said charge accumulated in said EL device via said second switch by connecting a negative electrode of said first power source with said one electrode of said EL device while said first switching is switched off and said second switch is switched on, and said circuit applies voltage of negative polarity to said one electrode of said EL device by connecting said negative electrode of said first power source with said one electrode of said EL device, then, discharges said charge accumulated in said EL device via said first switch by connecting a positive electrode of said first power source with said one electrode of said El device while said first switching is switched on and said second switch is switched off.

8. A driving device for EL device as recited in claim 7, wherein said first driving circuit includes a driver IC which receives voltage from said positive electrode and said negative electrode of said first power source via a voltage supply line.

* * * * *